US005768881A

United States Patent [19]

Lauschke

[11] Patent Number: 5,768,881

[45] **Date of Patent: *Jun. 23, 1998**

[54] YARN WITHDRAWAL NOZZLE FOR AN OPEN-END SPINNING MACHINE

[75] Inventor: Dieter Lauschke, Geislingen/Steige, Germany

[73] Assignees: Fritz Stahlecker, Bad Überkingen; Hans Stahlecker, Süssen, both of Germany

[ * ] Notice: The term of this patent shall not extend beyond the expiration date of Pat. No. 5,638,671.

[21] Appl. No.: 698,082

[22] Filed: Aug. 15, 1996

[30] Foreign Application Priority Data

Sep. 5, 1995 [DE] Germany ..... 195 32 735.7

[51] Int. Cl.[6] ..... D01H 4/00

[52] U.S. Cl. ..... 57/414; 57/404; 57/407

[58] Field of Search ..... 57/414, 415, 416, 57/417, 406, 352, 407

[56] References Cited

U.S. PATENT DOCUMENTS 5,537,810 7/1996 Pawaletz ..... 57/406
5,555,715 9/1996 Pawaletz et al. ..... 57/406 X
5,570,572 11/1996 Birkenmaier et al. ..... 57/406

FOREIGN PATENT DOCUMENTS

2745195A1 4/1978 Germany .
3729425A1 9/1988 Germany .
4022562 1/1992 Germany ..... 57/406

*Primary Examiner*—C. D. Crowder
*Assistant Examiner*—Tina R. Taylor
*Attorney, Agent, or Firm*—Evenson McKeown Edwards & Lenahan, PLLC

[57] ABSTRACT

A yarn withdrawal nozzle for an open-end rotor spinning machine is provided with at least one ferromagnetic member. The at least one ferromagnetic member serves to couple the yarn withdrawal nozzle to a holding device comprising at least one permanent magnet. The permanent magnet is arranged sunk in a recess. The at least one ferromagnetic member comprises a projection with a diameter of approximately 2 to 3 mm. The projection can be guided into the recess and thus can be positioned to the permanent magnet. The projection serves also as an anti-rotating device.

20 Claims, 2 Drawing Sheets

YARN WITHDRAWAL NOZZLE FOR AN OPEN-END SPINNING MACHINE

BACKGROUND AND SUMMARY OF THE INVENTION

A yarn withdrawal nozzle for an open-end rotor spinning machine is provided with at least one ferromagnetic means. This serves to couple the yarn withdrawal nozzle to a holding device comprising at least one permanent magnet. The permanent magnet is arranged sunk in a recess. The ferromagnetic means comprises a projection with a diameter of approximately 2 to 3 mm. The projection can be guided into the recess and thus can be positioned to the permanent magnet. The projection serves also as an anti-rotating device.

The present invention relates to a yarn withdrawal nozzle for an open-end rotor spinning machine, which yarn withdrawal nozzle is provided with at least one ferromagnetic means for coupling to a holding device which comprises at least one permanent magnet.

A known exchangeable yarn withdrawal nozzle of this type (U.S. Pat. No. 4,110,961) is connected by magnetic coupling means to a holding device comprising a yarn withdrawal duct. The yarn withdrawal nozzle itself can be made of ferromagnetic material or alternatively, it can be made of ceramic material joined by a ferromagnetic ring. An anti-rotating device for the yarn withdrawal nozzle is not provided.

A further known yarn withdrawal nozzle (U.S. Pat. 4,854,119) is made of ceramic material and comprises a ferromagnetic disc on its side facing the holding device, which ferromagnetic disc has the same diameter as the yarn withdrawal nozzle. A permanent magnet is adhered to the holding device, which permanent magnet is a flat ring disc having the same diameter as the ferromagnetic disc. The ring disc is recessed over a sector of 60°, so that a fiber feeding channel can be guided past. The yarn withdrawal nozzle is centered in a bore hole of the permanent magnet by means of a tube-shaped extension. An anti-rotating device is not provided in this case either.

Yarn withdrawal nozzles which can be coupled to a holding device magnetically have the advantage of taking up less space, as, for example, a fastening thread that is usually present can be omitted. With the high speeds common today, which can reach up to 150,000 revolutions per minute, the spinning rotor and the holding device arranged thereto are becoming smaller and smaller. This means that there is less space available for the permanent magnet or magnets. Smaller permanent magnets have, however, smaller holding power, with the risk that the yarn withdrawal nozzle, coupled magnetically to the holding device, could be forced to rotate by the drawn-off, crank-like circulating yarn.

It is an object of the present invention to create a yarn withdrawal nozzle which is suitable for coupling to even relatively weak permanent magnets, but which is also sufficiently secured against rotation in circumferential direction.

This object has been achieved in accordance with the present invention in that the ferromagnetic means has a projection measuring approximately 2 to 3 mm in diameter and fitting into a recess of the holding device in which recess a permanent magnet is located.

A similar yarn withdrawal nozzle is described in the co-pending U.S. patent application Ser. No. 08/539,704, but, however, there are no details of the size of the projection mentioned in this patent application.

As a result of the features according to the present invention, the ferromagnetic means of the yarn withdrawal nozzle acts also as an anti-rotating device. Thus, because of the small amount of space available, extra anti-rotating devices can be omitted. In addition, the yarn withdrawal nozzle is held in its pre-set correct position by the permanent magnets, so that an error in assembly is ruled out from the start.

The projection—a plurality of projections can be provided—is preferably pressed out of a circular ring-like plane of the ferromagnetic means. This type of pressing out procedure can be carried out with high precision and for relatively small diameters.

The ferromagnetic means has a plane surface the purpose of which is to provide a support free from play at a support surface of the holding device arranged thereat. As a result of the support, which is free from play, fibers do not get caught between the plane surface and the taking up surface of the holding device. In order to avoid redundancies with respect to the tolerances, a small gap can, if necessary, be provided between the projection and the surface of the magnet arranged thereto.

In an embodiment of the present invention the projection is arranged at an inclined sliding surface belonging to the recess, which sliding surface is provided for raising the projection from the permanent magnet when the yarn withdrawal nozzle is turned. The yarn withdrawal nozzle can be turned by hand around its assembly axis, whereby the magnetic force decreases so that the Yarn withdrawal nozzle can be easily removed from its holding.

Advantageously, two projections and two recesses are provided which lie diametrically opposed to one another. It has been shown that with the use of two magnets, despite the reduced amount of space available, the magnetic force is just about sufficient, as long as an anti-rotating device is present.

Other objects, advantages and novel features of the present invention will become apparent from the following detailed description of the invention when considered in conjunction with the accompanying drawings.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
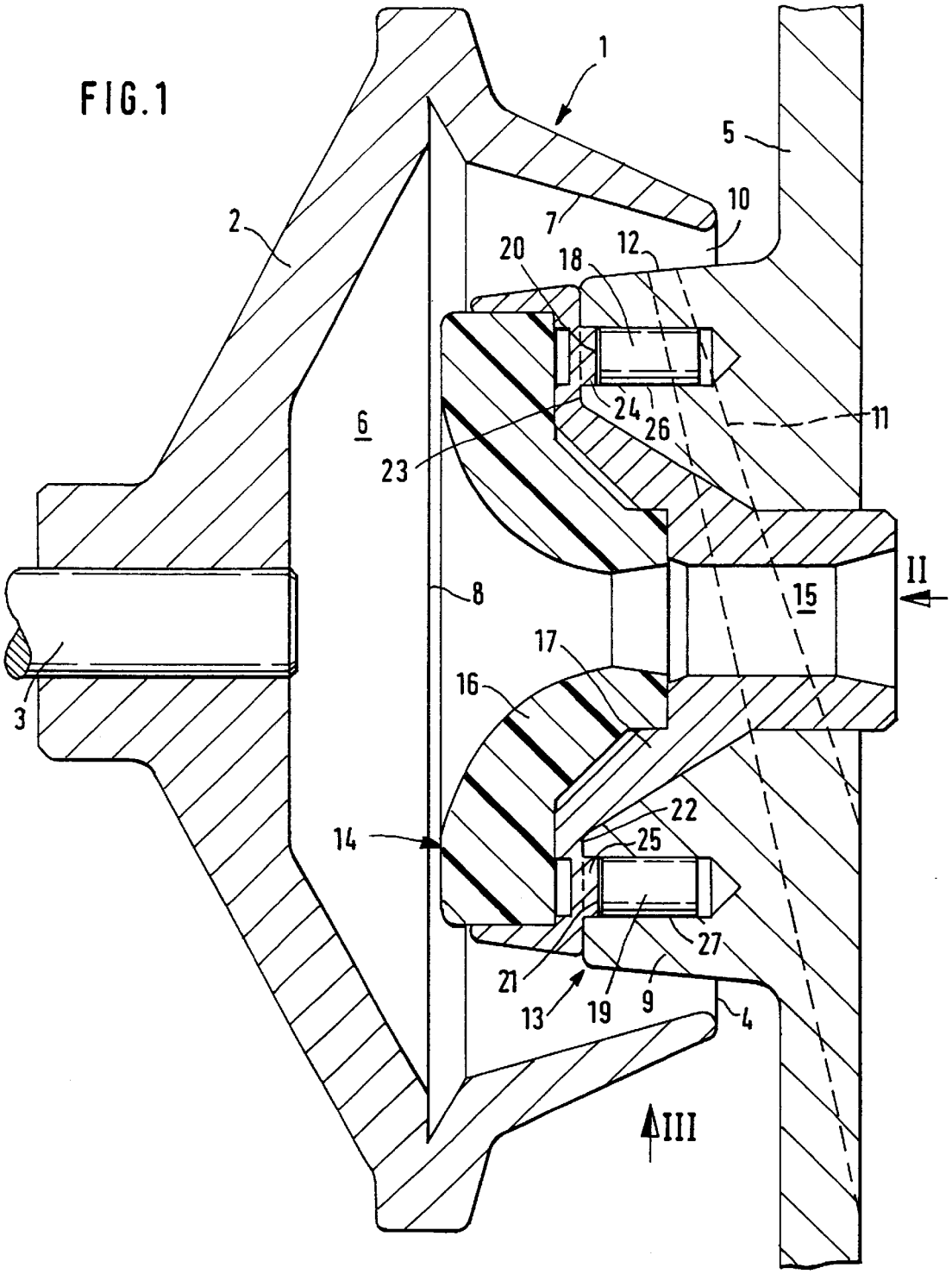
FIG. 1 is a greatly enlarged longitudinal section through a spinning rotor and through a yarn withdrawal nozzle which projects therein, constructed according to a preferred embodiment of the present invention.

FIG. 1 shows, greatly enlarged, a section of a spinning point of an open-end rotor spinning machine, namely in the area of the spinning rotor 1, which consists in the known way of a rotor cup 2 and a shaft 3 securely attached thereto. The rotor cup 2 runs during operation in a vacuum chamber (not shown) which is attached to a vacuum supply.

During operation, the open front side 4 of the rotor cup 2 is closed by a cover 5, which is disposed with a sealing effect on the vacuum chamber (not shown).

The rotor cup 2 has a fiber sliding surface 7 in its hollow interior 6, which sliding surface 7 extends conically from the open front side 4 to a fiber collecting groove 8. The fiber collecting groove 8 forms the largest diameter of the interior 6 of the rotor cup 2. During operation, the individual fibers fed in are deposited in the fiber collecting groove 8. The cover 5 is provided with an extension 9, which projects through the open front side 4 of the rotor cup 2 to within close proximity of the fiber collecting groove 8. Between the extension 9 and the open front side 4 of the rotor cup 2, there is an overflow gap 10 for removing the necessary spinning air. This spinning air is fed in through a fiber feed channel 11 in a known way and serves to transport the separated fibers to the fiber sliding surface 7 (not shown). The mouth 12 of the fiber feed channel 11 located in the extension 9 is arranged directly beside the fiber sliding surface 7, against which the fibers are forced, where they then slide into the fiber collecting groove 8.

The extension 9 is constructed as a holding device 13 for a yarn withdrawal nozzle 14. The yarn withdrawal nozzle 14 serves to draw off the spun yarn and it projects practically to within close proximity of the fiber collecting groove 8, where it re-directs the yarn withdrawn from the fiber collecting groove 8 in the direction of the axis of the shaft 3. The spun yarn is drawn off through a yarn withdrawal duct 15 of the yarn withdrawal nozzle 14 and fed to a winding device (not shown).

The yarn withdrawal nozzle 14 comprises a yarn inlet funnel 16 made of ceramic material, which funnel 16 forms the actual re-direction point of the yarn withdrawn from the fiber collecting groove 8 in the direction towards the yarn withdrawal duct 15. The funnel 16 is adhered to a nozzle holder 17, which forms part of a molded machine part made of steel. The nozzle holder 17 comprises a tube-shaped area, with which the nozzle holder 17 is held in a bore hole of the extension 9 of the cover 5 coaxially to the shaft 3.

Figure 2:
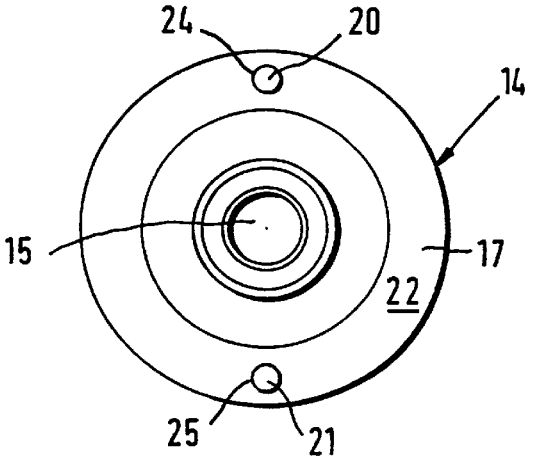
FIG. 2 is a reduced view of the yarn withdrawal nozzle in arrow direction II of FIG. 1.

The holding device 13 comprises two permanent magnets 18 and 19 which lie diametrically opposed to each other and which serve to couple the yarn withdrawal nozzle 14 to the holding device 13 magnetically (see also FIG. 2). For this purpose, the yarn withdrawal nozzle 14 comprises two ferromagnetic means 20 and 21, which are disposed, preferably without a gap, at the arranged surfaces of the permanent magnets 18 and 19. The permanent magnets 18 and 19 take the form of relatively short pins of approximately 2 to 3 mm in diameter.

The nozzle holder 17 of the yarn withdrawal nozzle 14 is disposed with a plane circular ring-like surface 22 at a corresponding support surface 23 of the holding device 13. In order to avoid redundancies with respect to tolerances, the ferromagnetic means 20 and 21 can have a very small clearance in comparison to the permanent magnets 18 and 19. However, should it be necessary, due to the weak magnetic forces, to dispose the ferromagnetic means 20 and 21 without clearance on the permanent magnets 18 and 19, then a small gap can be provided if required between the plane surface 22 and the support surface 23.

It is purposeful to provide an anti-rotating device for the yarn withdrawal nozzle 14 in particular in the case of weak permanent magnets 18 and 19, which are inevitably necessary due to the reduced amount of space available. The ferromagnetic means 20 and 21 carry out this additional function also. These means 20 and 21 take therefore the form of projections 24 and 25, which, like the permanent magnets 18 and 19, also have a diameter of approximately 2 to 3 mm. The projections 24 and 25 need not be exactly round, of course; for manufacturing or tolerance reasons, a slight deviation from absolute roundness is permissible. Essential is only that there is a sufficiently large ferromagnetic means 20 and 21 and that the yarn withdrawal nozzle 14 is secured against rotation.

The permanent magnets 18 and 19 are arranged somewhat sunk in cylindrical recesses 26 and 27 of the holding device 13, so that between the upper front surfaces of the permanent magnets 18 and 19 and the plane of the support surface 23 a small space remains into which the projections 24 and 25 engage. Thus the projections 24 and 25 serve on the one hand the magnetic coupling to the holding device 13 and on the other as an anti-rotating device.

The projections 24 and 25 are pressed out of a circular ring-like plane by means of a stamping process. This is cost-effective with respect to production and sufficiently exact.

Figure 4:
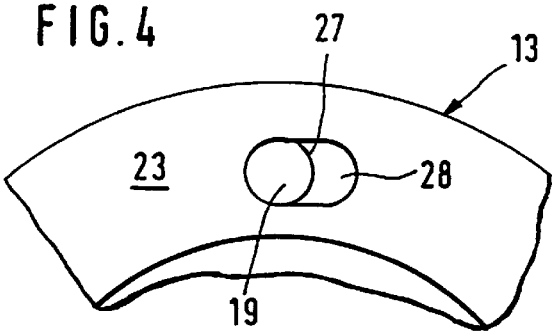
FIG. 4 is a partial view of the holding device in the direction of the arrow IV of FIG. 3.
Figure 3:
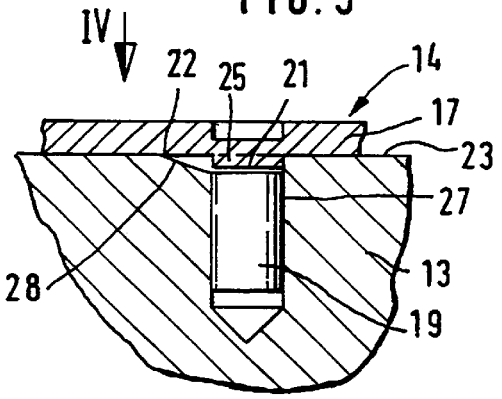
FIG. 3 is an enlarged partial view of the area of a permanent magnet in the direction of the arrow III of FIG. 1.

In order that the yarn withdrawal nozzle 14 can be easily removed from the holding device 13, the recesses 26 and 27 are provided with an inclined sliding surface 28 (see also FIGS. 3 and 4), which are provided for raising the ferromagnetic means 20 and 21 from the respective permanent magnets 18 and 19 when the yarn withdrawal nozzle 14 is turned. When the yarn withdrawal nozzle 14 is turned around its axis, the magnetic forces are reduced, which means that the yarn withdrawal nozzle 14 can be disassembled from the holding device 13 without the aid of a tool, that is, even without an extractor tongs.

The permanent magnets 18 and 19 are pressed into their respective recesses 26 and 27, namely just so far that the ferromagnetic means 20 and 21 of the projections 24 and 25 are disposed, preferably without leaving a gap, on the permanent magnets 18,19.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A yarn withdrawal nozzle for an open-end rotor spinning machine, said nozzle comprising at least one ferromagnetic member with at least one projection, said at least one projection fitting into a recess of a holding device, in which recess a permanent magnet is located spaced from an open end of said recess.

2. A yarn withdrawal nozzle according to claim 1, wherein the at least one projection is pressed out of a circular ring-like plane of a ferromagnetic plate.

3. A yarn withdrawal nozzle according to claim 2, wherein the holding device adjacent to the recess is provided with an inclined sliding surface for receiving the projection.

4. A yarn withdrawal nozzle according to claim 2, wherein two projections and two recesses are provided which are diametrically disposed to one another.

5. A yarn withdrawal nozzle according to claim 2, wherein the ferromagnetic member has a plane surface which is disposable free from play at a support surface of the holding device.

6. A yarn withdrawal nozzle according to claim 5, wherein the holding device adjacent to the recess is provided with an inclined sliding surface for receiving the projection.

7. A yarn withdrawal nozzle according to claim 5, wherein two projections and two recesses are provided which are diametrically disposed to one another.

8. A yarn withdrawal nozzle according to the claim 1, wherein the holding device adjacent to the recess is provided with an inclined sliding surface for receiving the projection.

9. A yarn withdrawal nozzle according to claim 8, wherein two projections and two recesses are provided which are diametrically disposed to one another.

10. A yarn withdrawal nozzle according to claim 1, wherein two projections and two recesses are provided which are diametrically disposed to one another.

11. A yarn withdrawal nozzle according to claim 1, wherein said at least one projection is disposed eccentrically with respect to a central axis of said nozzle.

12. A yarn withdrawal nozzle according to claim 15, wherein said at least one projection has a diameter of between 2 mm and 3 mm.

13. A yarn withdrawal nozzle according to claim 1, wherein said at least one projection has a diameter of between 2 mm and 3 mm.

14. A method of making a yarn withdrawal assembly for an open-end rotor spinning machine, comprising:

molding a nozzle holder with a tube-shaped section engageable in a cover member bore hole, forming a yarn inlet funnel and connecting same with the nozzle holder, providing at least one permanent magnet in a recess of the cover, said permanent magnet being spaced from an open end of the recess, providing at least one ferromagnetic projection on the nozzle holder, and detachably magnetically connecting the nozzle holder and cover member by positioning the projection in said recess.

15. A method according to claim 14, wherein said providing a projection includes stamping said projection from a planar plate extending parallel to a facing surface of the holder.

16. A method according to claim 14, wherein two projections and two recesses are provided which are diametrically disposed to one another.

17. A method according to claim 14, wherein the cover member adjacent to the recess is provided with an inclined sliding surface for receiving the projection.

18. A method according to claim 14, wherein said at least one projection is disposed eccentrically with respect to a central axis of said nozzle.

19. A method according to claim 18, wherein said at least one projection has a diameter of between 2 mm and 3 mm.

20. A method according to claim 14, wherein said at least one projection has a diameter of between 2 mm and 3 mm.

* * * * *